US005215030A

United States Patent [19]

Conti

[11] Patent Number: 5,215,030

[45] Date of Patent: Jun. 1, 1993

[54] ADJUSTABLE ANCHOR

[76] Inventor: James A. Conti, 520 Center Hill Rd., Pittsburgh, Pa. 15239

[21] Appl. No.: 953,844

[22] Filed: Sep. 30, 1992

[51] Int. Cl.[5] ..... B63B 21/30

[52] U.S. Cl. ..... 114/298; 114/304

[58] Field of Search ..... 114/294, 297, 298, 299, 114/301-307

[56] References Cited

U.S. PATENT DOCUMENTS 2,874,668 2/1959 Bailey ..... 114/298

4,005,671 2/1977 Ogle ..... 114/298

*Primary Examiner*—Jesus D. Sotelo

*Attorney, Agent, or Firm*—William J. Ruano

[57] ABSTRACT

An adjustable anchor comprising a vertical cylinder including a helical spring supported on a puck depending from a vertical rod terminating in an eye projecting above the cylinder. Three anchors 120° apart are pivotally supported by the puck so that upward pull on the eye by a rope will effect progressive retraction of the three anchors into corresponding openings in the cylinder against the resistance of the helical spring. An internally threaded cap of the cylinder screws onto external threads of the cylinder to adjust the tension of the spring.

1 Claim, 3 Drawing Sheets

ADJUSTABLE ANCHOR

This invention relates to an adjustable anchor.

BACKGROUND OF THE INVENTION

Anchors have the disadvantage of becoming hung-up or snagged to the bottom of lakes, rivers and oceans.

SUMMARY OF THE INVENTION

An object of the invention is to provide an adjustable anchor that will overcome the above-named disadvantages of existing anchors.

DESCRIPTION OF THE PREFERRED EMBODIMENT

Figure 1:
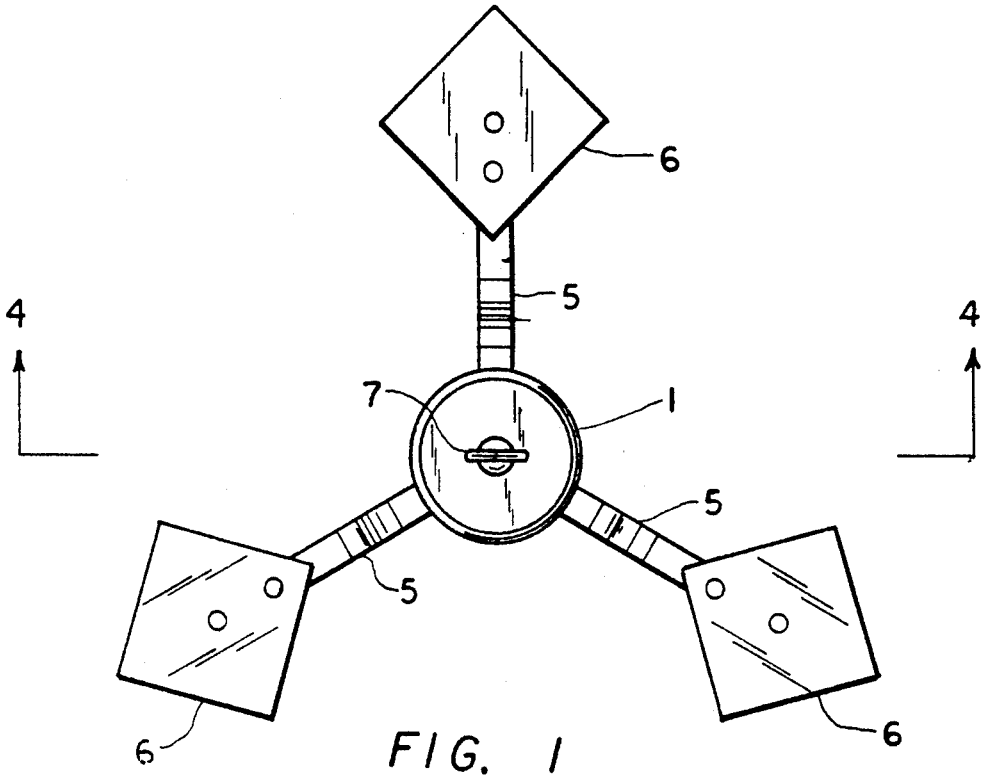
FIG. 1 is a top view of an adjustable anchor embodying the present invention.

Referring to FIGS. 1 to 4 inclusive, numeral 1 denotes a cover or mall insert bushing of an internally threaded cap 2 which screw threadedly engages threads 3 of a cylinder 4 having three lower openings through which emerge anchor arms 5 carrying rigidly connected anchors 6, and which anchor arms are tensioned by a helical spring 9.

Such tensioning occurs as the result of clockwise rotation of cap 2 (FIG. 4) whereby its internal threads engage threads 3 effecting lowering of cap 1.

Anchor rope eye 7 remains stationary during such lowering and constitutes a means for tying the end of the line suspended by the boat or ship and for supporting a stem integrally secured to plunger puck 10.

Spring 9 rests on a plunger puck 10 integrally supporting three equidistant anchor pivots 12 resting on pillar 5.

Figure 2:
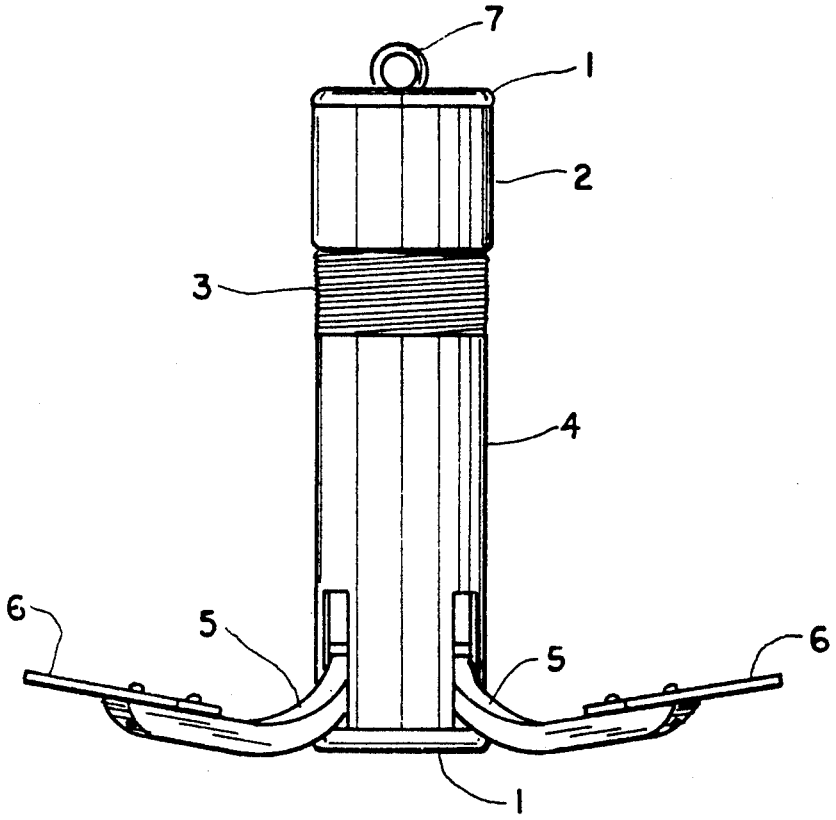
FIG. 2 is an elevational view thereof showing the arms in the normal fully extended position.
Figure 3:
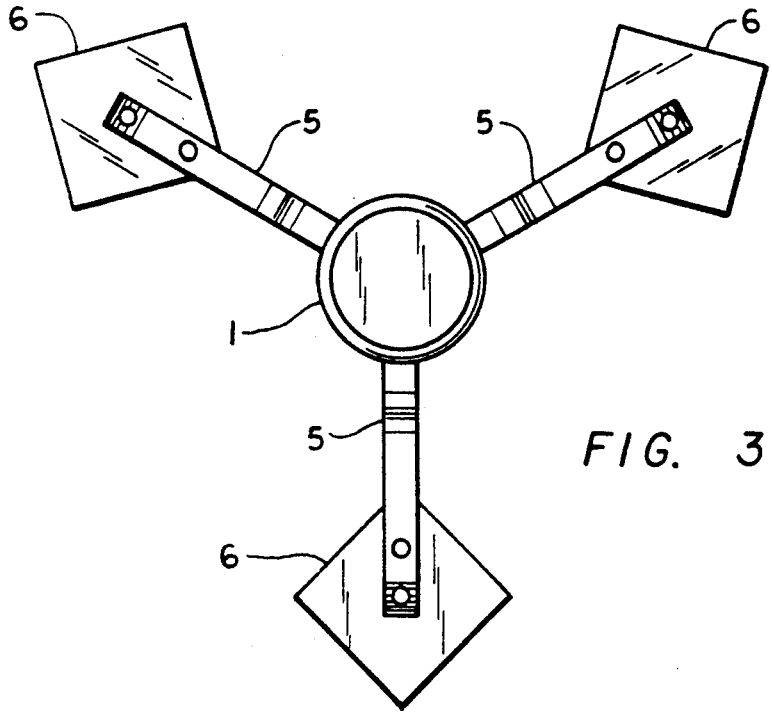
FIG. 3 is a bottom view thereof.
Figure 4:
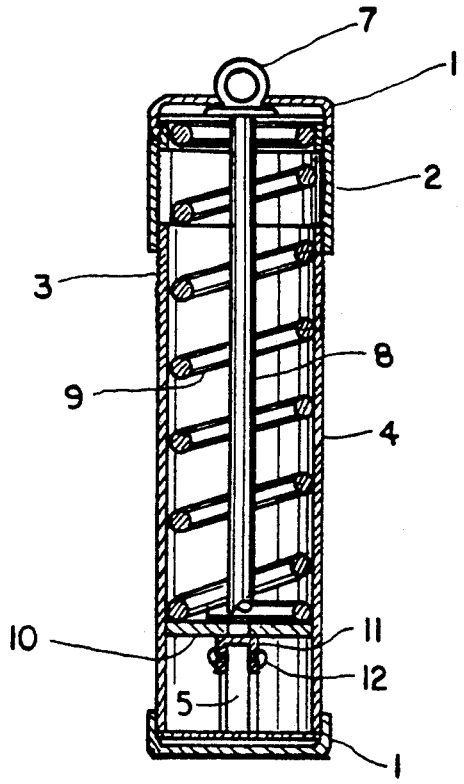
FIG. 4 is a vertical cross-sectional view taken along line 4—4 of FIG. 1.

In operation, the anchor is lowered onto the bottom of the lake, river or ocean in its fully extended position of anchors 6 as shown in FIG. 2.

Figure 6:
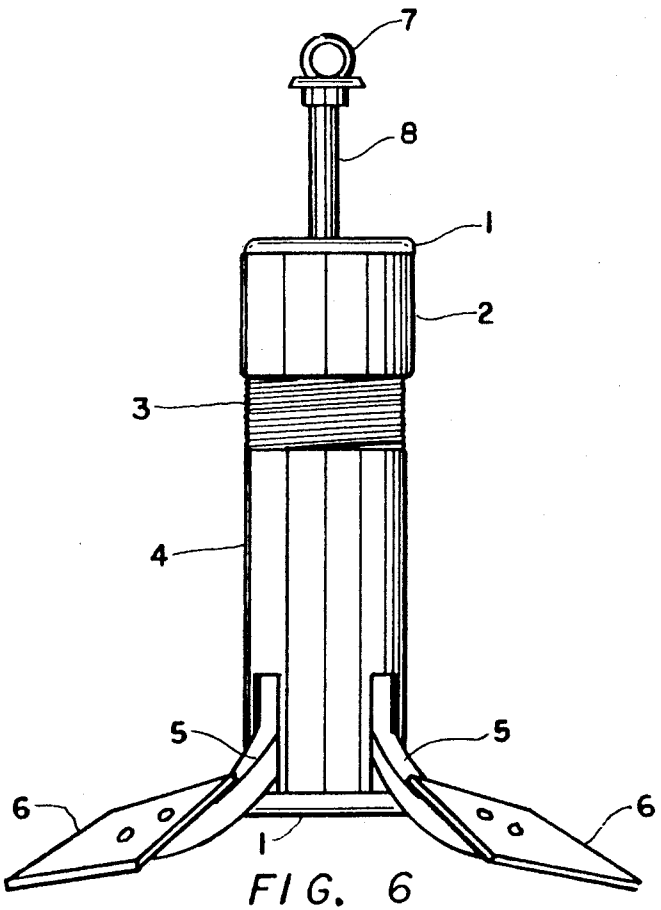
FIG. 6 is an elevational view showing the arms retracted half way into the anchor body.
Figure 5:
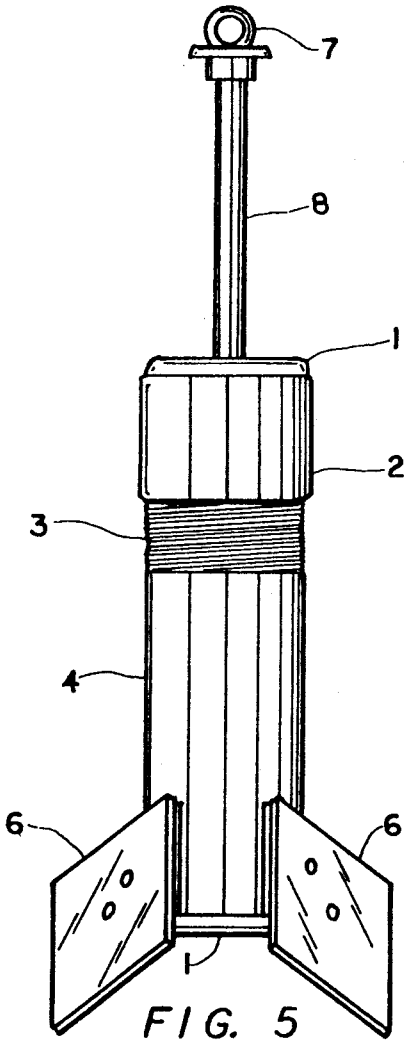
FIG. 5 is an elevational view showing the arms fully retracted into the anchor body.

When it is desired to retract anchors 6 from said bottom, pulling of the line will first retract anchors 6 to the position shown in FIG. 6 and if that is not sufficient to dislodge the anchors from said bottom, the line is pulled with greater force to the fully retracted position shown in FIG. 5 to surely prevent snagging and to surely remove the anchors 6 from said bottom.

Under severe water conditions such as high waves or high winds, the anchor arms will automatically retract and reset, thus letting the boat move with high waves and winds.

The great majority of presently used anchors would keep the boat locked to the bottom in these severe conditions, creating a great possibility of swamping the boat if the anchor could not be broken loose or the anchor rope cut free. The present invention totally eliminates these dangerous conditions.

The present invention is designed to work with several sizes of boats or ships. This is done by turning the tension adjustment all the way out for small boats and slowly turning the adjustment in as the size of the boats increase.

I claim:

1. An adjustable anchor for boats comprising a vertically extending cylinder having an externally threaded top portion and an internally threaded cap screw threaded to said top portion, three vertical slots 120° apart at the bottom portion of said cylinder, a helical spring contained within said cylinder, an anchor rope eye projecting upwardly of said cap, a vertically extending rod in said cylinder and integrally secured to said eye, a plunger puck forming a support for and secured to the bottom of said helical spring, three pivots 120° apart supported by said plunger puck, and three anchors pivotally supported on said three pivots, whereby upwardly pull on said eye will effect progressive retracting of said anchors into said cylinder through said three slots.

* * * * *